US012781301B2

(12) United States Patent
Dorfbauer et al.

(10) Patent No.: US 12,781,301 B2
(45) Date of Patent: Nov. 3, 2026

(54) METHOD FOR PROCESSING A STEEL SHEET

(71) Applicant: NanoNeal Technologies GmbH, Linz (AT)

(72) Inventors: Christian Dorfbauer, Linz (AT); Marius Kreuzeder, St. Pölten (AT)

(73) Assignee: NanoNeal Technologies GmbH, Linz (AT)

( * ) Notice: Subject to any disclaimer, the term of this patent is extended or adjusted under 35 U.S.C. 154(b) by 361 days.

(21) Appl. No.: 18/022,055

(22) PCT Filed: Aug. 18, 2021

(86) PCT No.: PCT/AT2021/060287
§ 371 (c)(1),
(2) Date: Feb. 17, 2023

(87) PCT Pub. No.: WO2022/036381
PCT Pub. Date: Feb. 24, 2022

(65) Prior Publication Data

US 2023/0304120 A1 Sep. 28, 2023

(30) Foreign Application Priority Data

Aug. 20, 2020 (AT) ..... A 50702/2020

(51) Int. Cl.
*C21D 9/46* (2006.01)
*B21B 45/06* (2006.01)
(Continued)

(52) U.S. Cl.
CPC ..... *C21D 9/46* (2013.01); *B21B 45/06* (2013.01); *B24C 1/086* (2013.01); *C21D 8/1222* (2013.01);
(Continued)

(58) Field of Classification Search
CPC ..... C21D 9/46; C21D 8/1222; C21D 8/1244; C21D 8/1277; C21D 11/00; C21D 1/26;
(Continued)

(56) References Cited

U.S. PATENT DOCUMENTS 3,021,237 A * 2/1962 Henke ..... C21D 8/1272 148/113
5,116,436 A 5/1992 Nishimoto et al.
(Continued)

FOREIGN PATENT DOCUMENTS

CN 1404420 A 3/2003
CN 103725995 A 4/2014
(Continued)

OTHER PUBLICATIONS

Duman Eyup et.al. [DE102011119395A1] (machine translation) (Year: 2012).*
(Continued)

*Primary Examiner* — Sally A Merkling
*Assistant Examiner* — Nazmun Nahar Shams
(74) *Attorney, Agent, or Firm* — FisherBroyles, LLP; Douglas P. LaLone

(57) ABSTRACT

A method for processing a siliceous, hot-rolled steel sheet for producing an electric steel strip, wherein the steel sheet contains more than 1.5% parts by weight of silicon. The method may include conducting a surface treatment in a device for removing oxide layers from a surface of the steel sheet to produce a cleaned steel sheet, and conducting a heat treatment of the cleaned steel sheet after the surface treatment in a hot-rolled strip annealing plant in an inert gas atmosphere. The surface treatment for removing the oxide layers may be carried out mechanically, without chemical descaling. The heat treatment of the cleaned steel sheet is carried out subsequent to the surface treatment.

20 Claims, 4 Drawing Sheets

(51) Int. Cl.

| | |
|---|---|
| ***B24C 1/08*** | (2006.01) |
| ***C21D 8/1216*** | (2026.01) |
| ***C21D 8/1244*** | (2026.01) |
| ***C21D 8/1277*** | (2026.01) |
| ***C21D 11/00*** | (2006.01) |

(52) U.S. Cl.
CPC ..... *C21D 8/1244* (2013.01); *C21D 8/1277* (2013.01); *C21D 11/00* (2013.01)

(58) Field of Classification Search
CPC ..... C21D 1/74; C21D 8/1261; C21D 9/561; C21D 1/28; C21D 1/32; C21D 1/34; C21D 9/56; B21B 45/06; B24C 1/086; C22C 38/02; C22C 38/34; B08B 3/022; B08B 3/041
See application file for complete search history.

(56) References Cited

U.S. PATENT DOCUMENTS

| | | | | |
|---|---|---|---|---|
| 5,164,024 | A | 11/1992 | Nishimoto et al. | |
| 6,088,895 | A * | 7/2000 | Nelson | B21B 45/06 29/81.03 |
| 6,776,857 | B2 | 8/2004 | Lee | |
| 11,214,846 | B2 * | 1/2022 | Palzer | C22C 38/04 |
| 11,239,012 | B2 | 2/2022 | Boettcher et al. | |
| 2003/0034593 | A1 * | 2/2003 | Lee | C21D 8/0278 148/602 |
| 2006/0086429 | A1 | 4/2006 | Houbaert | |
| 2013/0084785 | A1 | 4/2013 | Cho | |
| 2013/0205855 | A1 * | 8/2013 | Mackenzie | C21D 8/0226 72/39 |
| 2016/0111190 | A1 | 4/2016 | Boettcher et al. | |
| 2017/0283903 | A1 | 10/2017 | Boettcher et al. | |
| 2022/0081746 | A1 * | 3/2022 | Takatani | C22C 38/48 |

FOREIGN PATENT DOCUMENTS

| | | | |
|---|---|---|---|
| CN | 107002157 | A | 8/2017 |
| CN | 107245647 | B | 10/2017 |
| CN | 110438317 | A | 11/2019 |
| EP | 1509627 | A1 | 3/2005 |
| EP | 2862673 | A1 | 4/2015 |
| EP | 3530762 | A1 | 8/2019 |
| WO | 03095683 | A1 | 11/2003 |

OTHER PUBLICATIONS

International Search Report dated Nov. 11, 2021 for copending Int'l. Patent App. No. PCT/AT2021/060287.
Machine English translation for CN107245647A (equivalent translation for CN107245647B).

* cited by examiner

METHOD FOR PROCESSING A STEEL SHEET

CROSS-REFERENCE TO RELATED APPLICATIONS

This application claims priority to International Patent Application No. PCT/AT2021/060287, filed on Aug. 18, 2021, and Austrian Patent Application No. A50702/2020, filed on Aug. 20, 2020, the contents of both of which are hereby incorporated by reference in their entirety.

TECHNICAL FIELD

The disclosure relates to a method for processing a siliceous, hot-rolled steel sheet for producing an electric steel strip.

BACKGROUND

Steel sheets made of iron-silicon alloys having a high silicon content, in particular having a silicon content of more than 1.5%, are of great interest for a number of electrotechnical and/or electromagnetic applications. Such steel sheets, usually referred to as electrical sheets or electric steel strips, have a higher saturation magnetization combined with higher electrical resistance values, and thus offer the advantage of fewer magnetic losses, particularly in applications at higher frequencies. Such electric steel strips constitute an important base for building highly efficient electrical machines.

In order to produce such electrical sheets, after smelting the steel alloys, the melts are cast into so-called slabs. In a hot-rolling process, so-called hot-rolled strips are produced from this primary material. For this purpose, in case the primary material cools down in the meantime, the surfaces need to be reheated and descaled in order to remove remaining oxide layers. This is usually done by means of a chemical surface treatment carried out as a deoxidizing operation. The hot-rolled strips obtained are then rolled to form a cold-rolled strip. Finally, a heat treatment of the strips is carried out in annealing furnaces, wherein the formation of a crystalline structure favoring the desired properties is achieved by means of the annealing process.

In the intermediate stages of processing such steel strips into electrical sheets, the strips are wound up into rolls, so-called coils. In order to be able to carry out the production process in a continuous operation, intermediate stations, in which the coils are unwound, and the ends of the coils delivered successively are welded to one another, are provided in the production plants provided therefor. On the other hand, it is provided that, at the exit of the production plants, the continuous strips are cut and re-wound into coils.

SUMMARY

The object of the disclosure is to create a method for processing a siliceous, hot-rolled steel sheet for producing an electric steel strip, by means of which an improved uniformity of the surfaces and of the optical appearance of the electric steel strip can be achieved.

The object of the disclosure is achieved by a method for processing a siliceous, hot-rolled steel sheet for producing an electric steel strip, wherein the steel sheet contains more than 1.5% parts by weight of silicon, with a surface treatment in a device for removing oxide layers from a surface of the steel sheet and with a heat treatment, wherein the surface treatment for removing the oxide layers takes place mechanically, without chemical descaling, and wherein the heat treatment of the cleaned steel sheet is performed after the surface treatment in a hot wall annealing plant in an inert gas atmosphere. The method proves particularly environmentally friendly as, in this process, the surface descaling is performed without the use of chemical substances. The application of the method particularly for processing steel sheets and/or steel strips with a silicon content of more than 1.5 wt. %, in particular for steel strips with a silicon content of between 2% and 4% proves advantageous.

The mechanical surface treatment is advantageously carried out with a granular material, wherein particles of the granular material are accelerated and blasted at the surface of the steel sheet.

According to a preferred measure, in the method, the mechanical surface treatment is performed using a suspension, wherein the granular materials are suspended in a liquid. Thereby, the formation of dust, as it occurs in a sandblasting operation, can be avoided. The use of particles of a small grain size of the granular material is also possible here.

An advancement of the method, wherein the mechanical surface treatment comprises a treatment by means of shot blasting, which is carried out prior to the surface treatment using the granular material, is also advantageous.

In a preferred procedure, the mechanical surface treatment and the heat treatment are performed in a continuous process, wherein the belt speed of the steel sheet is the same in the region of the mechanical surface treatment and in the region of the heat treatment.

The hot-rolled strip annealing plant comprises a heating region, a holding region, and a cooling region, wherein the steel sheet is heated in the heating region to a maximum temperature in a range of 800° C. to 1130° C. during a heating phase. The heating is advantageously carried out at a heating rate of 2° C./s to 15° C./s.

According to a preferred approach, it is provided that, during the holding phase, the steel sheet is held at the maximum temperature in a holding region for a duration of 15 s to 180 s, preferably for a duration of 45 s to 120 s.

Advantageously, the speed of the movement of the steel sheet is controlled dependent on a heating performance of the hot-rolled strip annealing plant.

In a preferred procedure, the speed of the movement of the steel sheet is calculated based on a mathematical-physical computational model of the hot-rolled strip annealing plant.

It is also advantageous that an inert gas atmosphere consisting of hydrogen and/or nitrogen is provided in the hot-rolled strip annealing plant.

Advantageously, hydrogen with a proportion of 50% to 100%, in particular with a proportion of 80% to 100%, is provided in the inert gas atmosphere.

According to an advancement of the procedure, it is provided that water vapor with a proportion corresponding to a dew point of −70° C. to −20° C. is contained in the inert gas atmosphere.

In a preferred procedure, the steel sheet is moved in a vertical conveying direction in the hot-rolled strip annealing plant.

The method is particularly suitable for steel sheet having a thickness value of 0.5 mm to 3.0 mm, preferably with a value of 0.6 mm to 2.8 mm.

For the purpose of better understanding of the invention, it will be elucidated in more detail by means of the figures below.

BRIEF DESCRIPTION OF THE DRAWINGS

These show in a respectively very simplified schematic representation.

DETAILED DESCRIPTION

First of all, it is to be noted that in the different embodiments described, equal parts are provided with equal reference numbers and/or equal component designations, where the disclosures contained in the entire description may be analogously transferred to equal parts with equal reference numbers and/or equal component designations. Moreover, the specifications of location, such as at the top, at the bottom, at the side, chosen in the description refer to the directly described and depicted figure and in case of a change of position, these specifications of location are to be analogously transferred to the new position.

Figure 1:
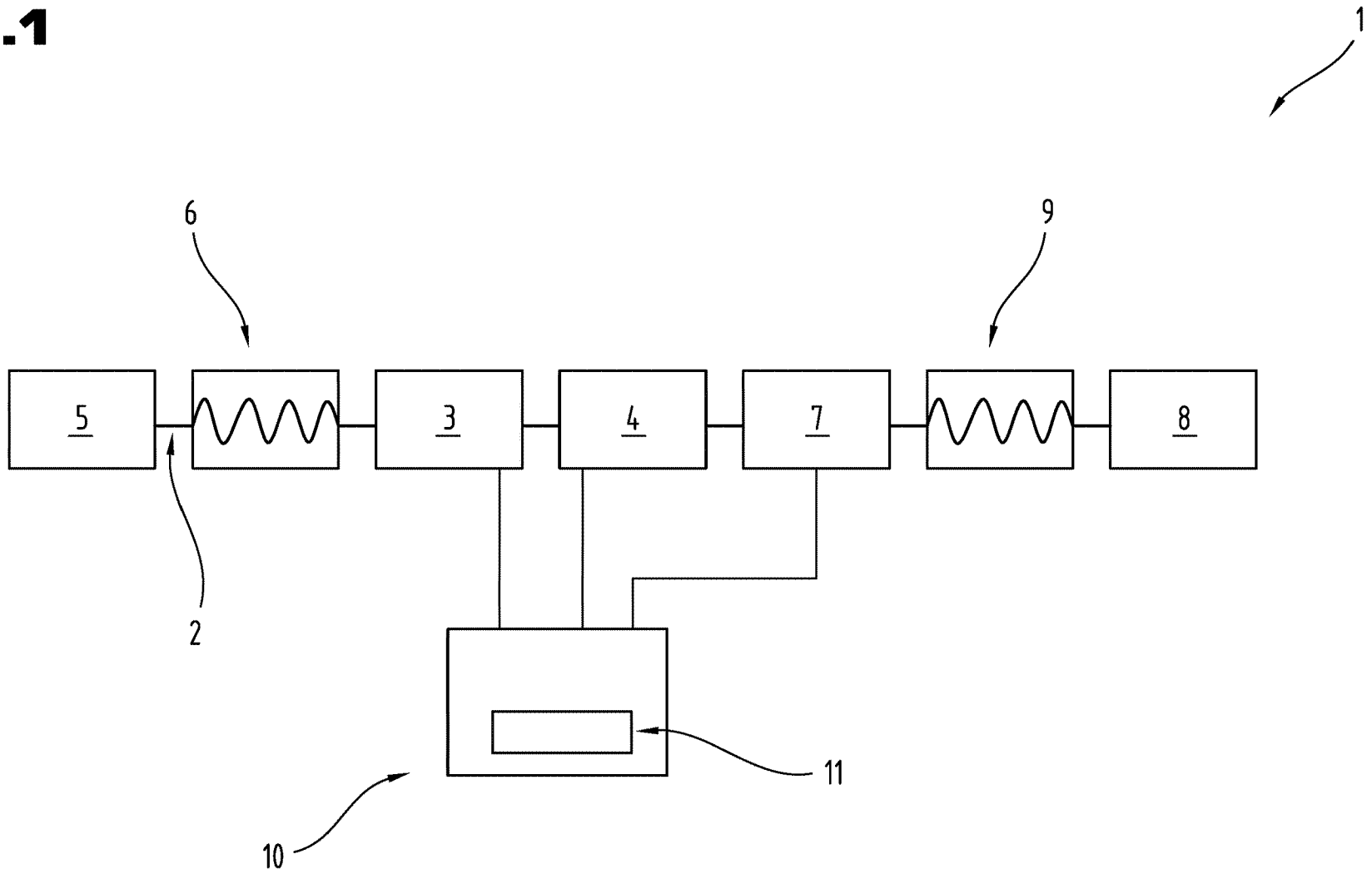
FIG. 1 shows a device for processing a siliceous, hot-rolled steel sheet.

FIG. 1 shows a device 1 for processing a siliceous, hot-rolled steel sheet 2 for producing an electric steel strip. In this regard, the steel sheet 2 processed in the device 1 is a hot-rolled steel sheet with a thickness in the range of 0.5 mm to 3 mm, wherein the obtained intermediate product is suitable and/or prepared for a subsequent cold-rolling operation. In this regard, for processing, the steel sheet 2 is moved in a continuous succession through multiple, successively arranged processing stations of the device 1. As a central processing station, the device 1 comprises a device for surface treatment 3 and a device for heat treatment 4.

In this regard, a preparation station 5 for provisioning the endlessly fed steel sheet 2 forms the beginning. By means of the preparation station 5, multiple processes such as the unwinding of the steel sheet 2 from corresponding coils, a cutting and smoothing of the edges, and the welding of the successive ends of multiple rolls are symbolically aggregated. For compensating and/or adjusting different speeds of the movement of the steel sheet 2 between the preparation station 5, on the one hand, and the subsequent devices for surface treatment and the heat treatment 3,4, on the other hand, a strip accumulator 6 in the form of a loop former is provided.

In this exemplary embodiment of the device 1 for processing the steel sheet 2, said steel sheet 2 is subjected to a mechanical treatment in the device for surface treatment 3 for removing oxide layers from the surface of the steel sheet 2. This means that in this device for surface treatment 3, an otherwise common chemical treatment for descaling the steel sheet 2 is not applied. In this regard, the mechanical surface treatment is carried out using a granular material, as it is known as the so-called sandblasting. In this process, particles of the granular material are accelerated in an air stream and projected onto the steel sheet 2 at a high speed, so that the adherent oxide layers are removed in the process.

According to a preferred embodiment, a treatment with granular materials suspended in a liquid is carried out in the device for surface treatment 3 for mechanically removing the oxide layers from the surface of the steel sheet 2. In addition to the actual abrasives, the watery slurry (suspension) also contains substances protecting against corrosion or also soaps for increasing the cleaning effect. Such a mechanical surface treatment is also known as "slurry blasting". An advantage of the surface treatment with such suspensions is, inter alia, that in the process, particles of the granular material having significantly smaller grain sizes may be used.

When processing the siliceous, hot-rolled steel sheet in the device 1, a heat treatment of the cleaned steel sheet 2 in the hot-rolled strip annealing plant 4 using an inert gas atmosphere is provided subsequent to the mechanical surface treatment. In this process, the inert gas atmosphere contains hydrogen and oxygen, wherein a content of 50% to 100% of hydrogen is provided. Preferably, a content of 80% to 100% of hydrogen is provided in the inert gas atmosphere. It is particularly advantageous if only as little a remainder of water vapor as possible is contained in the inert gas atmosphere. Favorably, water vapor is present in the inert gas atmosphere with a content that corresponds to a dew point of −70° C. to −20° C. This allows preventing that oxide layers reform on the surface of the steel sheet 2 during the heat treatment of the steel sheet 2 in the hot-rolled strip annealing plant 4 at the high temperatures prevailing therein with the oxygen of the water molecules.

Between the mechanical surface treatment in the device 3 and the heat treatment in the hot-rolled strip annealing plant 4, an additional cleaning step may also be provided in the process, in which residues, such as for example residual oxides, are removed from the surface.

Subsequent to the heat treatment in the hot-rolled strip annealing plant 4, the steel sheet 2 is moved through, inter alia, a measuring station 7, where a measurement of the grain size in the steel sheet 2 is performed. By means of measuring the grain size in the measuring station 7, the formation of the desired crystalline structure in the steel sheet 2 can be checked. The thusly obtained information on the quality of the steel sheet 2 obtained by the treatment also serves as the basis for controlling the course of the treatment in the device 1.

For transferring the steel sheet 2 into a post-processing station 8, a second strip accumulator 9 is provided at the exit side. Here, the post-processing station 8 represents multiple individual stations and/or post-processing and checking operations on the steel sheet 2, which is finally cut into partial strips again and wound up to form corresponding coils. This also includes cutting the edges of the steel sheet 2, checking for defects, and passivating the surface of the steel sheet 2 by applying a corrosion protection, such as oil.

For performing the method for processing the steel sheet 2, a control device 10 is provided. The control is carried out particularly such that the treatment in the device for surface treatment 3 and in the device for heat treatment 4 proceeds in a continuous process, wherein the speed of the movement of the steel sheet 2 is the same at least in the region of the devices 3,4 for mechanical surface treatment and for heat treatment. The control device 10 controls the speed of the steel sheet 2 as a function of the heating performance of the hot-rolled strip annealing plant 4. The processing in the device for surface treatment 3, i.e. the intensity of the removal of the oxide layers, is consequently adjusted by the control device 10 dependent on the predefined belt speed of the steel sheet 2. According to a preferred embodiment of the method, a mathematical-physical computational model 11 is provided in the control device 10, on the basis of which the heating performance in the hot-rolled strip annealing plant 4 and—dependent thereon—the speed of the movement of the steel sheet 2 required for obtaining the desired crystalline structure are calculated.

In an alternative exemplary embodiment of the method, the device for surface treatment 3 comprises a high-pressure water jet plant. In this process, a water jet is projected at the steel sheet 2 at a high pressure in a range of more than 150 bar, in order to thus remove the oxide layer. Preferably, a pulsating high-pressure water jet is used. The pulsation causes a chiseling effect. Such an apparatus is equipped with solid jet nozzles or fan nozzles, which are directed at the surface of the steel sheet 2 in a single or multiple rotating, oscillating, or "fixed" manner.

Figure 2:
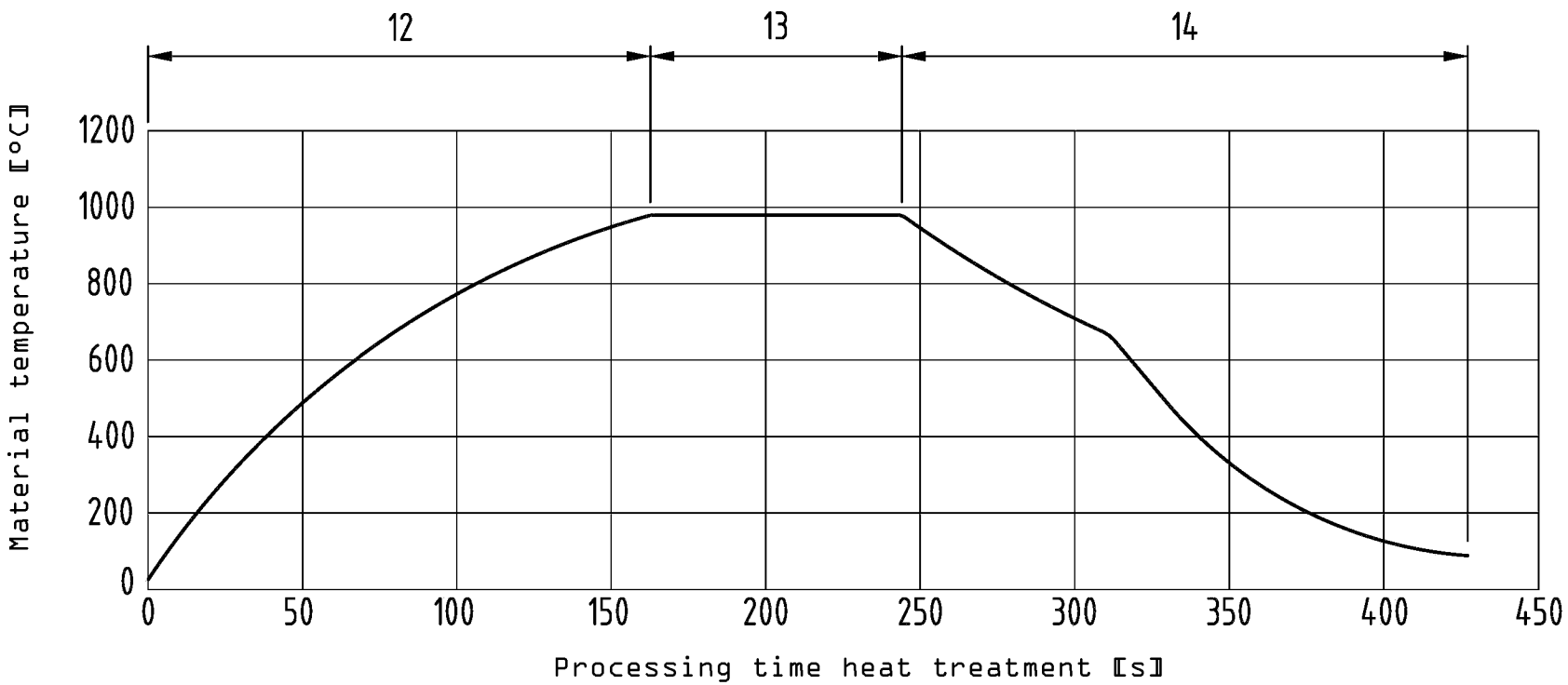
FIG. 2 shows a diagram of the temporal progress of the temperature of the steel sheet during the heat treatment in the hot-rolled strip annealing plant.

With reference to FIG. 2, the operating principle of the hot-rolled strip annealing plant 4 is explained in more detail in the following. FIG. 2 shows a diagram of the chronological sequence of the temperature of the steel sheet 2 during the heat treatment in the hot-rolled strip annealing plant 4. In the temperature progression, a distinction is to be made between a heating phase 12, a holding phase 13, and a cooling phase 14. The steel sheet 2 coming from the mechanical surface treatment in the device 3, first passes through a heating region of the hot-rolled strip annealing plant 4, and the temperature is finally increased during the heating phase 12 to a maximum temperature in a range of 800 degrees to 1130 degrees. During this heating phase 12 in the heating region, the heating takes place at a heating rate of 2° C./s to 15° C./s. Subsequently, during the holding phase 13 the temperature of the steel sheet 2 is held at the previously reached maximum temperature for a duration of 15 seconds to 180 seconds, preferably for a duration of 45 seconds to 120 seconds. In the subsequent cooling phase 14, the steel sheet 2 is cooled in a first section, mainly by dissipating radiant heat, in a later section by dissipating heat by means of convection.

In the annealing furnaces used as the hot-rolled strip annealing plant 4, a distinction can be made between those with a horizontal conveying direction of the steel sheet 2 and those with a vertical conveying direction. In the case of a furnace with a horizontal conveying direction of the steel sheet 2, the hot-rolled strip annealing plant 4 naturally also comprises rollers, by which the steel sheet 2 moved through the furnace is held and/or supported. According to a preferred embodiment, a furnace with a vertical main conveying direction is used as the hot-rolled strip annealing plant 4. Thereby, it can advantageously be achieved that the steel sheet 2 has as little contact as possible, in particular the hot steel sheet 2 has no contact at all, with rollers otherwise required to guide it. Any damage of the surface of the steel sheet 2, for example due to scoring upon the rolling of support rollers on its surface, can thus be prevented.

Figure 4:
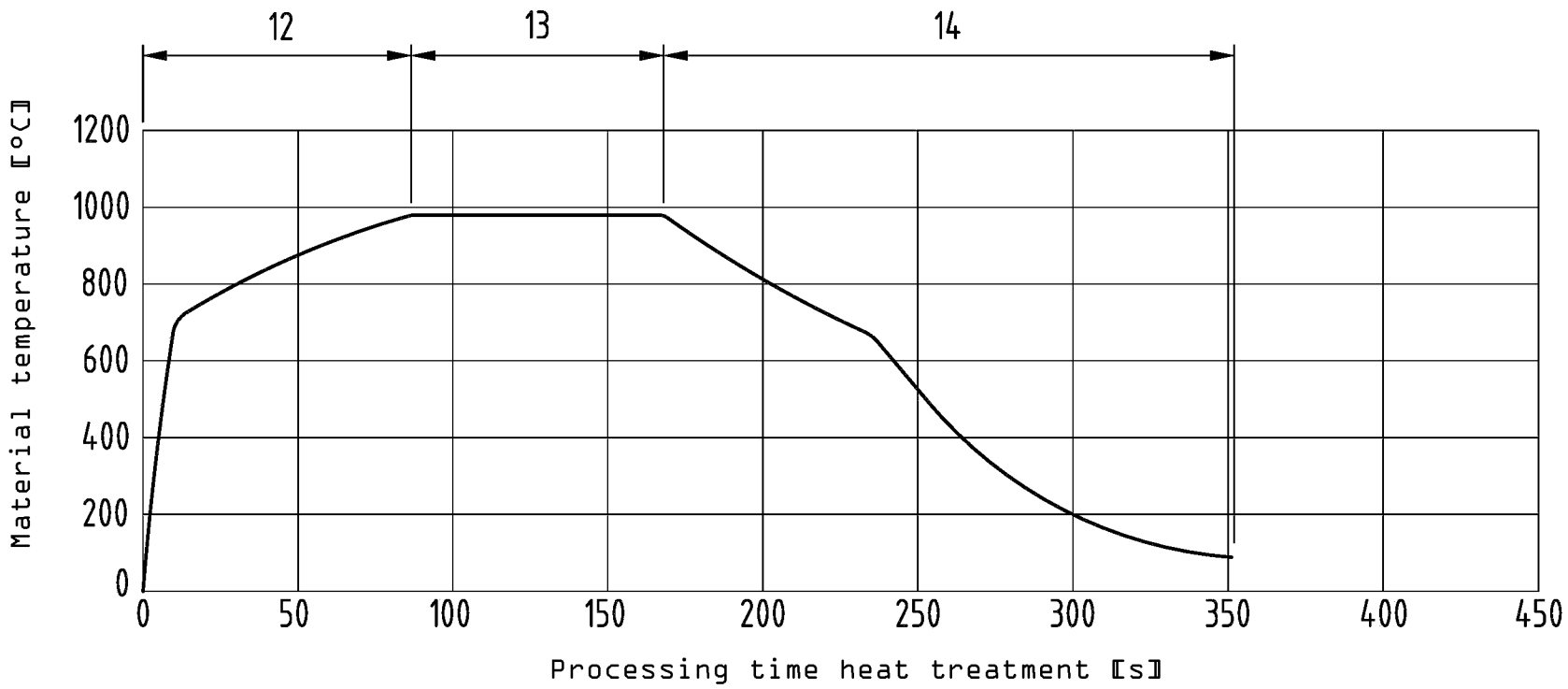
FIG. 4. shows the temporal progress of the temperature of the steel sheet during the heat treatment according to an alternative exemplary embodiment.

FIG. 4 shows a diagram of the chronological sequence of the temperature of the steel sheet 2 during the heat treatment in the hot-rolled strip annealing plant 4 according to an alternative exemplary embodiment. In this regard, the hot-rolled strip annealing plant 4 comprises an inductive furnace for heating the steel sheet 2, wherein significantly higher heating rates in a range of 20° C./s to 600° C./s can be achieved. Accordingly, the temperature increase in the diagram of FIG. 4 shows a significantly steeper progression in a first section of the heating phase 12, compared to the temperature progression according to FIG. 2. The heating in a first section of the heating phase 12, up to about 700° C., is preferably performed at a heating phase in the range of 20° C./s to 600° C./s. Subsequently, in a second section, the heating up to the maximum temperature is continued again at a heating rate of 2° C./s to 15° C./s.

Figure 3:
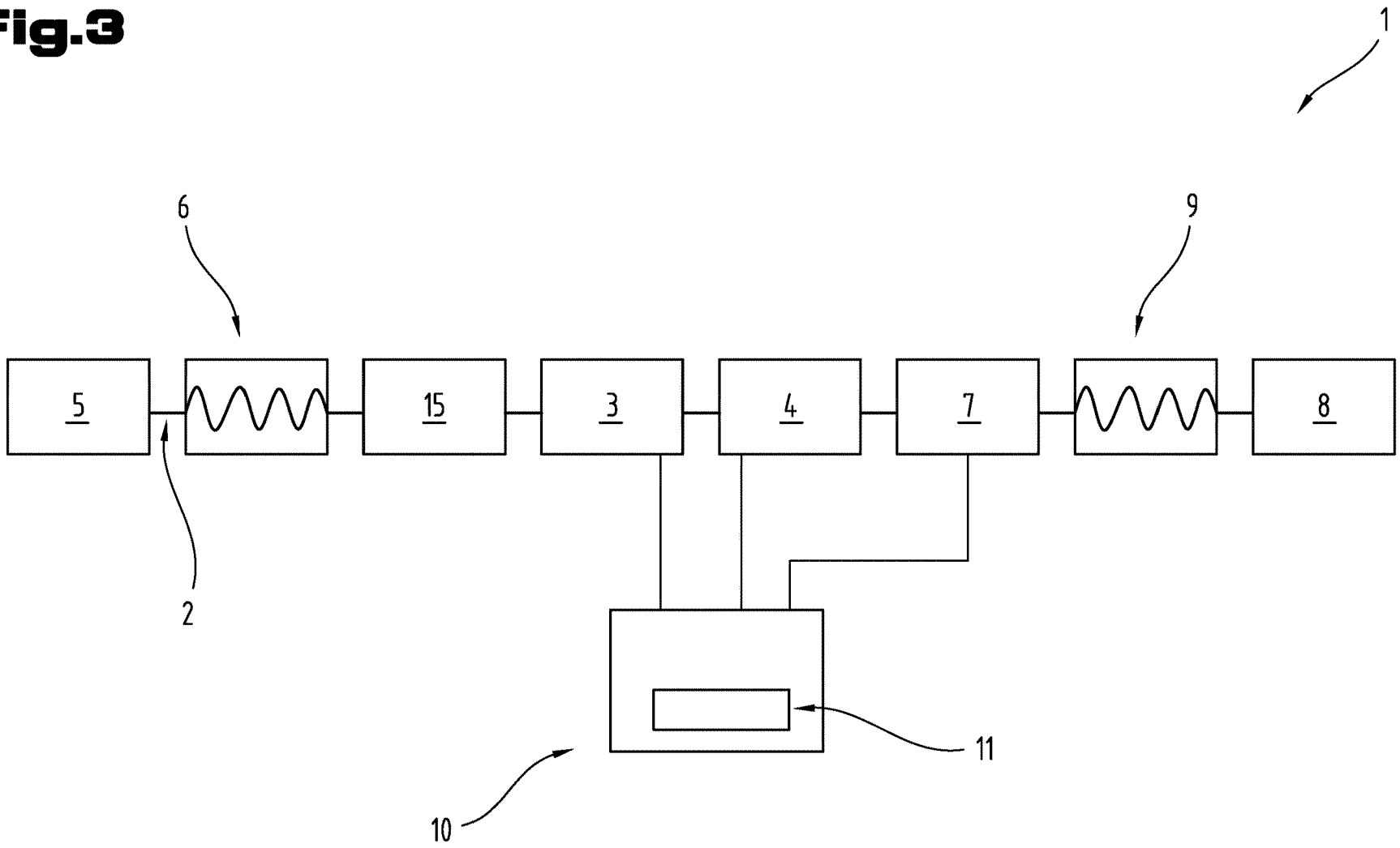
FIG. 3 shows a second exemplary embodiment of a device for processing a siliceous, hot-rolled steel sheet.

FIG. 3 shows a further and possibly independent embodiment to the device 1, wherein again, equal reference numbers and/or component designations are used for equal parts as before in FIG. 1, 2. In order to avoid unnecessary repetitions, it is pointed to/reference is made to the detailed description in the preceding.

FIG. 3 shows a second exemplary embodiment of a device for performing a method for processing a siliceous, hot-rolled siliceous 2 for producing an electric steel strip. In the device 1 according to this exemplary embodiment, the steel sheet 2 is subjected to a preparatory mechanical steel sheet in a shot blasting device 15 prior to the mechanical surface treatment in the device 3. In this process, steel balls are used as the blasting agent. Following the processing in the shot blasting device 15, the steel sheet 2 is moved further into the device for surface treatment 3, where a mechanical surface treatment as already described above in the first exemplary embodiment is carried out. Just as described in the first exemplary embodiment, the movement of the steel sheet 2 through the device 1 is carried out while being controlled by the control device 10. In this regard, the steel sheet 2 has the same strip speed at least in the region of the device 1 spanning the shot blasting device 15, the device for surface treatment 3 and the device for heat treatment 4. The steel sheet 2 passing through this region in the form of an endless strip is finally cut up and wound onto coils with the interposition of the strip accumulator 9 in the post-processing station 8.

In a further, alternative exemplary embodiment, the surface treatment is performed in the device 3 before the strip accumulator 6 on the entry side.

The steel sheet 2, which is eventually obtained by means of the processing according to the methods described, is suitable as a semifinished product for producing an electric steel strip and has a particularly high homogeneity and significantly improved surface quality. This is available as a semifinished product for a subsequent further processing in a cold-rolling process. The application of the method is particularly suitable for processing steel sheets and/or steel strips with a silicon content of more than 1.5 wt. %, in particular for steel strips with a weight proportion of silicon of between 2% and 4%.

With the method according to the disclosure, a higher surface roughness of the strip (for the steel sheet 2) can be achieved. This increased surface roughness allows for an increased strip temperature absorption and/or improved strip emissivity, whereby the heated furnace length can possibly be reduced. The surface roughness (average roughness value Ra pursuant to DIN EN ISO 4287 2010) may be between 2 μm and 8 μm, in particular between 2.5 μm and 4 μm.

When cooling a coil for the steel sheet 2 after the upstream hot-rolling process on the feeding station (coiler) at high temperatures (500-700° C.), an increased oxidation of the strip surface occurs on the strip edges and strip ends. This results in greater oxide layer thicknesses on the edges of the coil than in the center of the coil due to the better accessibility of the strip edges for the atmospheric oxygen. This increased oxide layer can be removed better/in a more controlled manner with the mechanical "pickling method" as compared to a chemical picking method. The chemical pickle has a very similar effect across the entire surface. The controlled, mechanical descaling using the method according to the disclosure can be improved if a particle recognition system (camera system) is used, by means of which the amount of particles blasted onto the strip and/or their speed (more or faster particles are blasted e.g. onto the strip edge region than onto the center of the strip) is checked and/or monitored. In cooperation with the improved heat radiation absorption (strip emissivity) across the strip width and strip length, so-called pickling edges can be avoided, which means a fluctuation of the heat radiation absorption across the strip length and strip width during the heat treatment and manifest as annealing edges in the prior art.

In the prior art, the (optical) irregularity of the surface is panned in the subsequent cold-rolling process and may have a negative effect afterwards, in the final annealing step at the annealing and coating line. The different heat radiation absorption of the strip surface across the strip width may result in an increased strip lengthening on the strip edges compared to the center of the strip and may show as edge waviness. Additionally, this often result in different magnetic and mechanical properties for the darker edge regions with an increased heat radiation absorption as compared to the center of the strip. With the method according to the disclosure, these darker and lighter regions across the strip width can be avoided. In the final, downstream concluding annealing of the end product on the annealing and coating line after a cold-rolling process, this leads to very homogenous mechanical, magnetic, and geometrical properties across the entire material unit compared to the conventional production methods.

The further cleaning of the strip after mechanical descaling may be carried out by means of multiple brush pairs and multiple rinsing sections with water in a strip cleaning operation. Subsequently, the strip may be dried. By means of this cleaning, residual oxides and lubricants present on the surface can be removed. This cleaning step may also be carried out using a lye as a cleaning agent or an electrolytical strip cleaning. By means of this cleaning, a contamination of the atmosphere in the furnace due to evaporation of the lubricant and/or buildups of oxides on the transport rollers due to "loose" residual oxides on the strip in the furnace and, thus, quality problems (e.g., impressions) during the heat treatment can be avoided.

The heat treatment of the strip preferably directly follows its descaling (mechanically and possible the described further cleaning).

With the method according to the disclosure, a blank and rough surface can be achieved. The even microstructure from the mechanical descaling, and the directly subsequent heat treatment with a highly hydrogenous, reducing atmosphere allows for an improved base material for subsequent cold-rolling and final annealing processes and for an end product with improved geometrical properties and high structural homogeneity (minimal fluctuations of grain size across the strip length and strip width).

The exemplary embodiments show possible embodiment variants, and it should be noted in this respect that the disclosure is not restricted to these particular illustrated embodiment variants of it, but that rather also various combinations of the individual embodiment variants are possible and that this possibility of variation owing to the technical teaching provided by the present invention lies within the ability of the person skilled in the art in this technical field.

The scope of protection is determined by the claims. Nevertheless, the description and drawings are to be used for construing the claims. Individual features or feature combinations from the different exemplary embodiments shown and described may represent independent inventive solutions. The object underlying the independent inventive solutions may be gathered from the description.

All indications regarding ranges of values in the present description are to be understood such that these also comprise random and all partial ranges from it, for example, the indication 1 to 10 is to be understood such that it comprises all partial ranges based on the lower limit 1 and the upper limit 10, i.e. all partial ranges start with a lower limit of 1 or larger and end with an upper limit of 10 or less, for example 1 through 1.7, or 3.2 through 8.1, or 5.5 through 10.

Finally, as a matter of form, it should be noted that for ease of understanding of the structure, elements are partially not depicted to scale and/or are enlarged and/or are reduced in size.

LIST OF REFERENCE NUMBERS

1 Device
2 Steel sheet
3 Device for surface treatment
4 Device for heat treatment
Preparation station
6 Strip accumulator
7 Measuring station
8 Post-processing station
9 Strip accumulator
10 Controller
11 Computational model
12 Heating phase
13 Holding phase
14 Cooling phase
15 Shot blasting device

The invention claimed is:

1. A method for processing a siliceous, hot-rolled steel sheet for producing an electric steel strip, wherein the hot rolled steel sheet contains more than 1.5% parts by weight of silicon, the method comprising steps of:

conducting a surface treatment in a device for removing oxide layers from a surface of the hot-rolled steel sheet to produce a cleaned steel sheet;

providing a cleaning step where residues are removed from the surface of the cleaned steel sheet; and conducting a heat treatment of the cleaned steel sheet after the cleaning step in a hot-rolled strip annealing plant in an inert gas, hydrogenous reducing, atmosphere; the inert gas atmosphere contains water vapor with a proportion corresponding with a dew point of −70° C. to −20° C.;

wherein the surface treatment for removing the oxide layers is carried out mechanically on the hot-rolled steel sheet, but without chemical descaling; and the heat treatment of the cleaned steel sheet is carried out subsequent to the surface treatment and the cleaning step.

2. The method according to claim 1, wherein the mechanical surface treatment is carried out with a granular material, and particles of the granular material are accelerated and blasted at the surface of the steel sheet.

3. The method according to claim 2, wherein the mechanical surface treatment is performed using a suspension, and the granular materials are suspended in a liquid.

4. The method according to claim 1, wherein the mechanical surface treatment is performed using a high-pressure water jet with a water pressure in a range of more than 150 bar.

5. The method according to claim 1, wherein the mechanical surface treatment includes a treatment via shot blasting that is carried out prior to the surface treatment using the granular material.

6. The method according to claim 1, wherein the mechanical surface treatment and the heat treatment are performed in a continuous process, and a speed of the movement of the cleaned steel sheet is the same in the region of the mechanical surface treatment and in the region of the heat treatment.

7. The method according to claim 1, wherein the hot-rolled strip annealing plant includes a heating region, a holding region, and a cooling region.

8. The method according to claim 1, wherein during a heating phase, the cleaned steel sheet is heated in the heating region to a maximum temperature in a range of 800° C. to 1130° C., and the heating is performed at a heating rate of 2° C./s to 15° C./s.

9. The method according to claim 1, wherein during a heating phase, the cleaned steel sheet is heated in the heating region to a maximum temperature in a range of 800° C. to 1130° C., and the heating is performed at a heating rate of 20° C./s to 600° C./s.

10. The method according to claim 1, wherein during a holding phase, the cleaned steel sheet is held at the maximum temperature in a holding region for a duration of 15 s to 180 s.

11. The method according to claim 1, wherein a speed of the movement of the cleaned steel sheet is controlled dependent on a heating performance of the hot-rolled strip annealing plant.

12. The method according to claim 1, wherein a speed of the movement of the cleaned steel sheet is calculated based on a mathematical-physical computational model of the hot-rolled strip annealing plant.

13. The method according to claim 1, wherein an inert gas atmosphere consisting of hydrogen and/or nitrogen is provided in the hot-rolled strip annealing plant.

14. The method according to claim 1, wherein hydrogen with a proportion of 50% to 100% is provided in the inert gas atmosphere.

15. The method according to claim 1, wherein the cleaned steel sheet is moved in the hot-rolled strip annealing plant in a horizontal conveying direction.

16. The method according to claim 1, wherein the cleaned steel sheet is moved in the hot-rolled strip annealing plant in a vertical conveying direction.

17. The method according to claim 1, wherein the steel sheet has a thickness of 0.5 mm to 3.0 mm.

18. The method according to claim 1, the cleaned steel sheet includes 2% to 4% parts by weight of silicon.

19. The method according to claim 1, wherein during a holding phase, the cleaned steel sheet is held at the maximum temperature in a holding region for a duration of 45 s to 120 s.

20. A method for manufacturing a hot-rolled steel sheet that can be used as an electric steel strip, wherein the hot-rolled steel sheet contains more than 1.5% parts by weight of silicon, the method comprising steps of:

surface treating a steel sheet to remove oxide layers from a surface of the hot-rolled steel sheet to produce a cleaned steel sheet;

removing residues from the surface of the cleaned steel sheet; and heat treating the cleaned steel sheet after the removing residues in an inert gas, hydrogenous reducing, atmosphere of a hot-rolled strip annealing plant, wherein the inert gas atmosphere contains water vapor with a proportion corresponding with a dew point of −70° C. to −20° C.;

wherein the surface treatment for removing the oxide layers is carried out mechanically, without chemical descaling;

the heat treatment of the cleaned steel sheet is carried out subsequent to the surface treatment and the removing residues step.

* * * * *